US007896440B2

(12) United States Patent
Tsai

(10) Patent No.: US 7,896,440 B2
(45) Date of Patent: Mar. 1, 2011

(54) CHAIR ARMREST HAVING A HEIGHT ADJUSTABLE FUNCTION

(76) Inventor: Po-Chuan Tsai, Tainan Hsien (TW)

( * ) Notice: Subject to any disclaimer, the term of this patent is extended or adjusted under 35 U.S.C. 154(b) by 253 days.

(21) Appl. No.: 12/210,387

(22) Filed: Sep. 15, 2008

(65) Prior Publication Data

US 2010/0066147 A1 Mar. 18, 2010

(51) Int. Cl.
*B60N 2/02* (2006.01)

(52) U.S. Cl. ..... 297/353; 297/411.36

(58) Field of Classification Search ..... 297/353, 297/411.36

See application file for complete search history.

(56) References Cited

U.S. PATENT DOCUMENTS 5,382,079 A * 1/1995 Wilson et al. ..... 297/411.36
5,599,067 A * 2/1997 Schuelke et al. ..... 297/411.35
5,931,537 A * 8/1999 Gollin et al. ..... 297/411.36
6,010,193 A * 1/2000 Hara et al. ..... 297/411.35
6,053,579 A * 4/2000 Nelson et al. ..... 297/411.36
6,824,218 B1 * 11/2004 van Hekken ..... 297/411.36
7,011,371 B1 * 3/2006 Tsai ..... 297/411.36
7,234,779 B2 * 6/2007 Bedford et al. ..... 297/411.36
7,448,687 B2 * 11/2008 Tsai ..... 297/411.36
7,661,763 B2 * 2/2010 Tsai ..... 297/411.36
2007/0164595 A1 * 7/2007 Chi ..... 297/411.36

* cited by examiner

*Primary Examiner* — David Dunn
*Assistant Examiner* — Erika Garrett
(74) *Attorney, Agent, or Firm* — Alan Kamrath; Kamrath & Associates PA

(57) ABSTRACT

An armrest for a chair includes an armrest support, a sleeve movably mounted on the armrest support, a support arm mounted on the sleeve, a locking member secured in the armrest support, and a lifting device mounted between the armrest support and the sleeve. Thus, when the drive lever of the lifting device is pressed upward, the movable shaft of the lifting device is unlocked from the locking member so that the movable shaft is movable in the locking member and the armrest support freely, and the sleeve is movable relative to the armrest support to adjust the height of the support arm.

14 Claims, 7 Drawing Sheets

CHAIR ARMREST HAVING A HEIGHT ADJUSTABLE FUNCTION

BACKGROUND OF THE INVENTION

1. Field of the Invention

The present invention relates to an armrest and, more particularly, to an armrest for a chair.

2. Description of the Related Art

A conventional chair comprises a seat, a stand mounted on the bottom of the seat, two armrests mounted on the top of the seat, and a backrest mounted on the top of the seat and located between the two armrests. However, each of the two armrests of the chair has a fixed structure, so that the height of each of the two armrests cannot be adjusted according to a user's requirement.

BRIEF SUMMARY OF THE INVENTION

In accordance with the present invention, there is provided an armrest for a chair, comprising an armrest support, a sleeve movably and adjustably mounted on the armrest support, a support arm mounted on the sleeve to move with the sleeve, a locking member secured in the armrest support and located in the sleeve, and a lifting device mounted between the armrest support and the sleeve and operable between a first position where the lifting device is locked by the locking member to lock the sleeve onto the armrest support and a second position where the lifting device is unlocked from the locking member to unlock the sleeve from the armrest support so that the sleeve is movable relative to the armrest support freely.

The primary objective of the present invention is to provide an armrest for a chair, wherein when the drive knob of the drive lever is pressed upward, the movable shaft is unlocked from the locking member so that the movable shaft is movable in the locking member and the support post of the armrest support freely, and the sleeve is movable relative to the support post of the armrest support to adjust the height of the support arm.

Another objective of the present invention is to provide an armrest for a chair, wherein a user only needs to press the drive knob of the drive lever so as to adjust the height of the support arm so that the height of the support arm is adjusted easily and quickly in an energy-saving manner, thereby facilitating the user adjusting the height of the support arm 6.

A further objective of the present invention is to provide an armrest for a chair, wherein when the sleeve is movable relative to the support post of the armrest support, the pressing pin is pushed by the elastic member to press the inner wall of the sleeve to prevent the sleeve from being vibrated or swayed during movement of the sleeve on the support post of the armrest support.

A further objective of the present invention is to provide an armrest for a chair, wherein the elastic member provides a buffering effect to the sleeve so that the sleeve is movable on the support post of the armrest support smoothly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
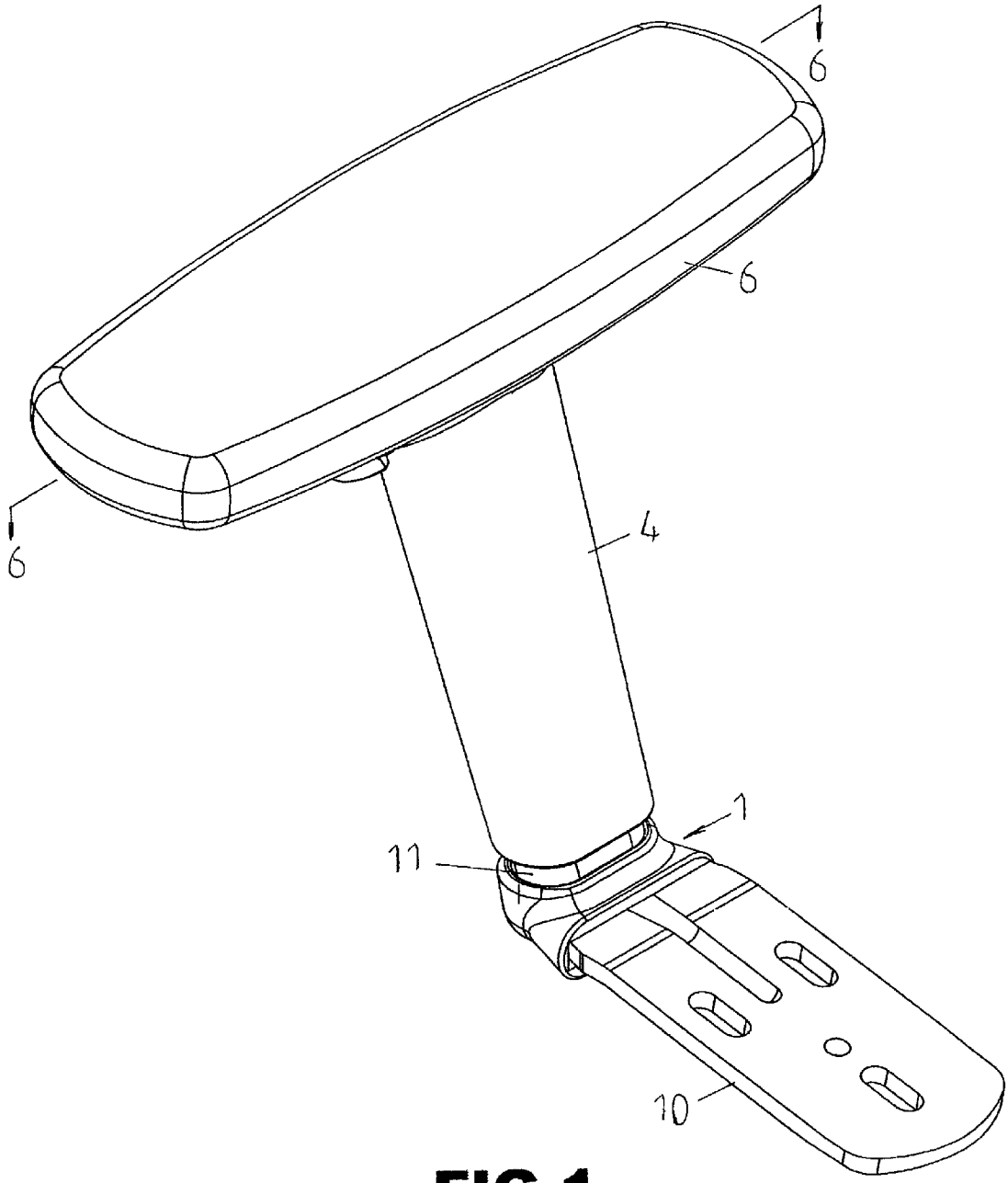
FIG. 1 is a perspective view of an armrest for a chair in accordance with the preferred embodiment of the present invention.
Figure 2:
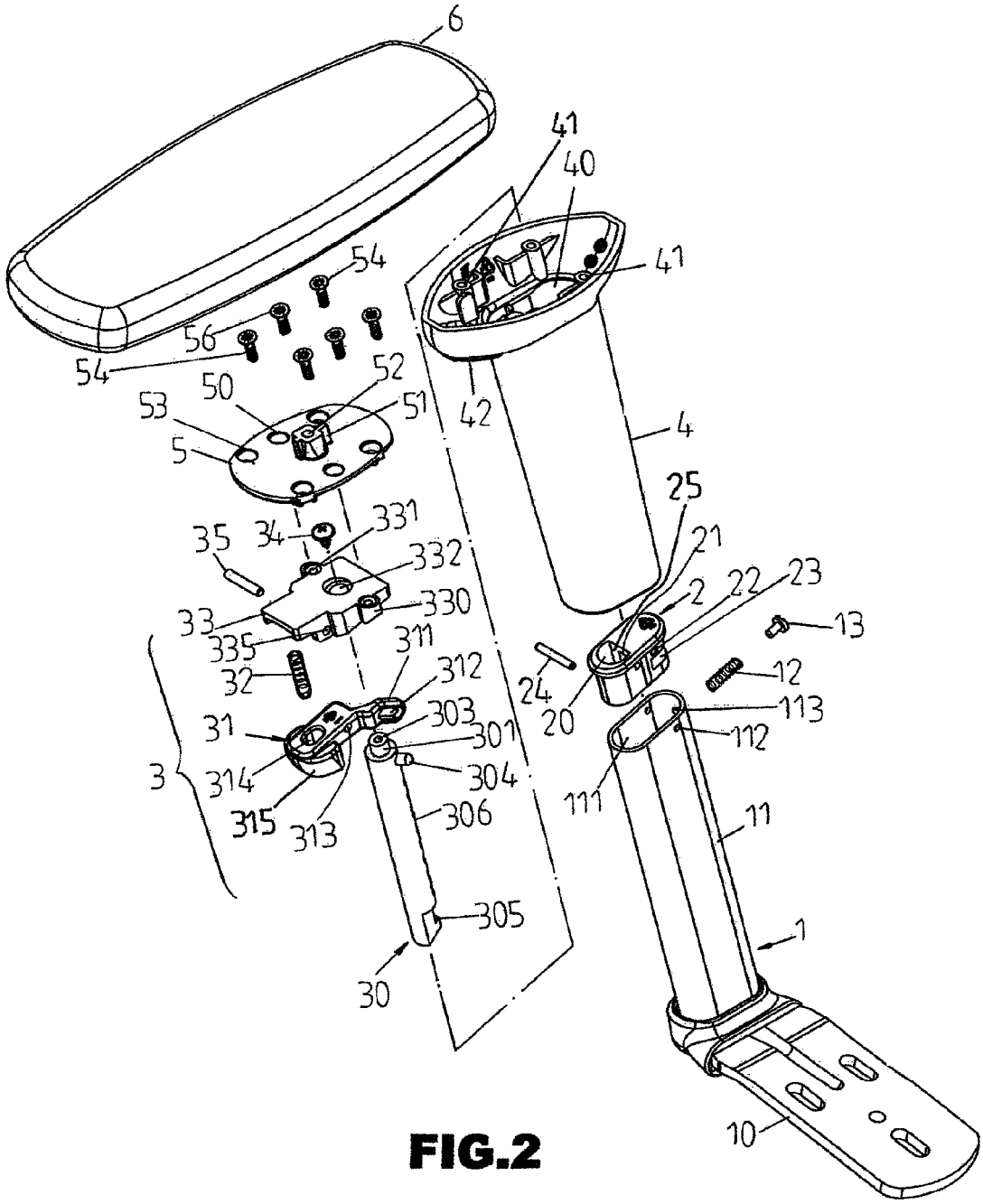
FIG. 2 is an exploded perspective view of the armrest for a chair as shown in FIG. 1.
Figure 3:
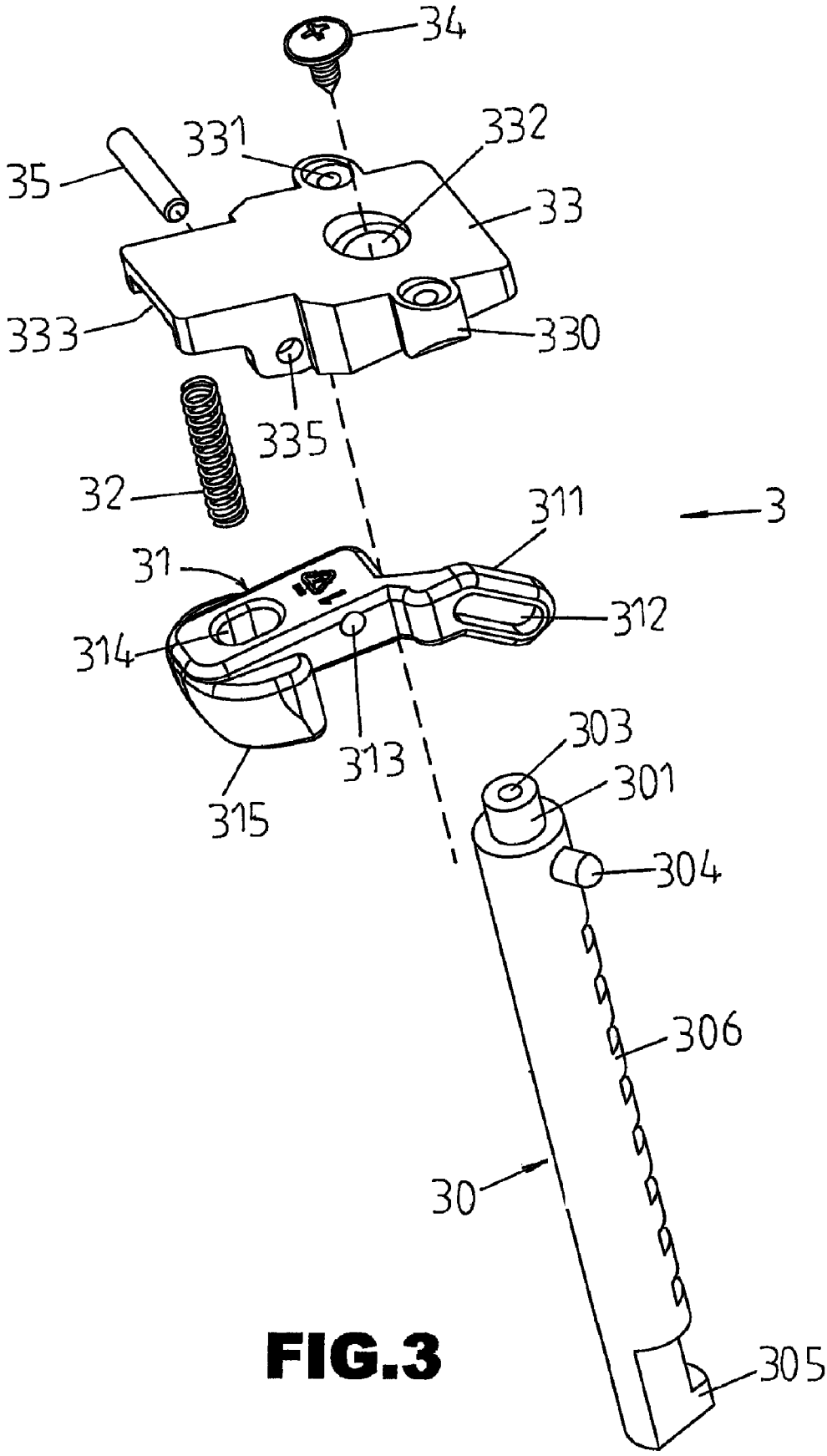
FIG. 3 is an exploded perspective view of a lifting device of the armrest for a chair as shown in FIG. 2.
Figure 4:
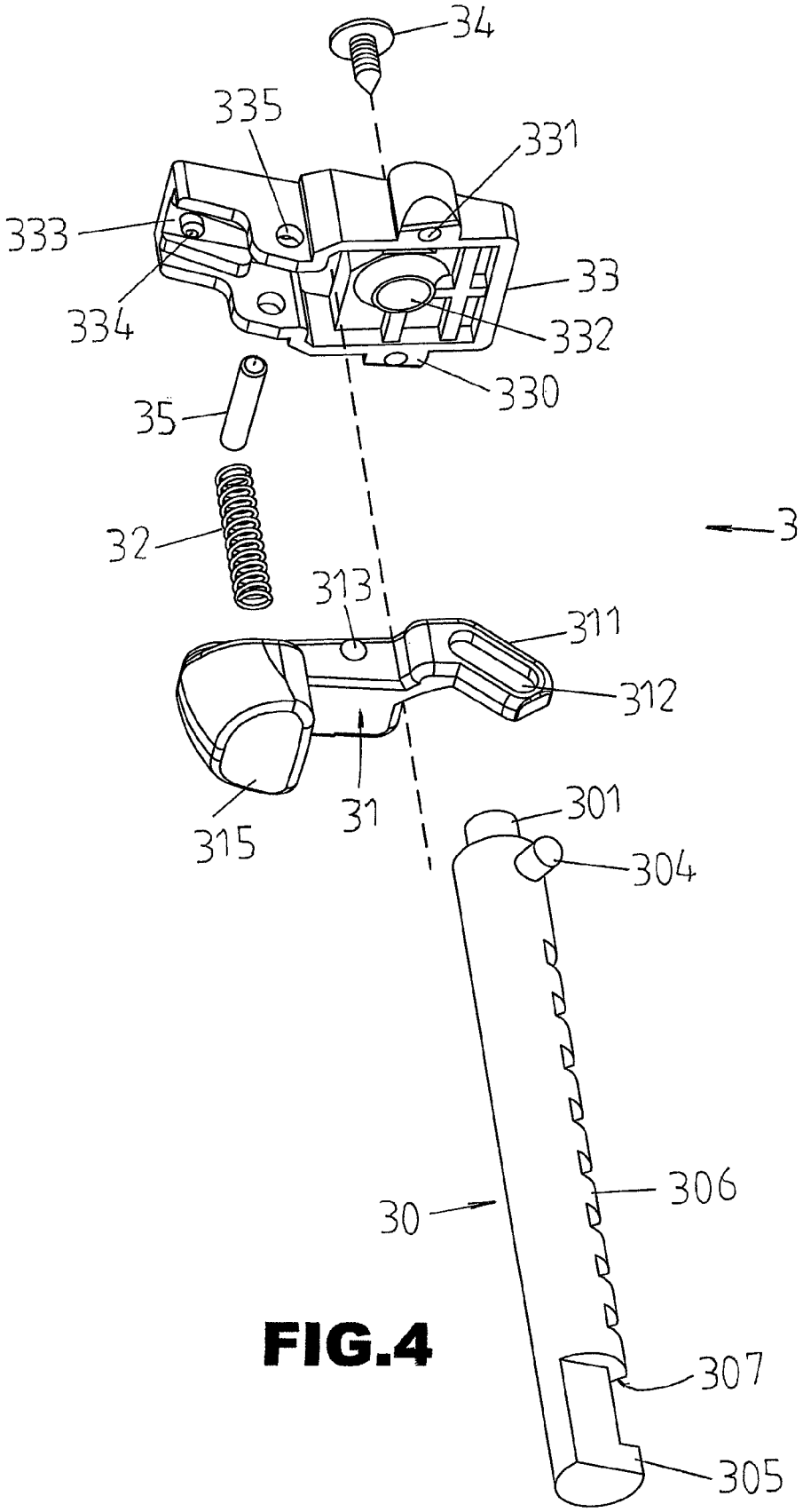
FIG. 4 is an another exploded perspective view of the lifting device of the armrest for a chair as shown in FIG. 2.

Referring to the drawings and initially to FIGS. 1-7, an armrest for a chair in accordance with the preferred embodiment of the present invention comprises an armrest support 1, a sleeve 4 movably and adjustably mounted on the armrest support 1, a support arm 6 mounted on the sleeve 4 to move with the sleeve 4, a locking member 2 secured in the armrest support 1 and located in the sleeve 4, and a lifting device 3 mounted between the armrest support 1 and the sleeve 4 and operable between a first position where the lifting device 3 is locked by the locking member 2 to lock the sleeve 4 onto the armrest support 1 and a second position where the lifting device 3 is unlocked from the locking member 2 to unlock the sleeve 4 from the armrest support 1 so that the sleeve 4 is movable relative to the armrest support 1 freely.

The armrest support 1 includes an upright support post 11 having an inside provided with a receiving chamber 111 to receive the lifting device 3 and a transverse connecting member 10 mounted on a lower end of the support post 11. The receiving chamber 111 of the support post 11 has a substantially oblong profile. The support post 11 of the armrest support 1 has an upper end provided with two opposite pin holes 112 and a passage 113.

The locking member 2 is mounted on the upper end of the support post 11 and is received in the receiving chamber 111 of the support post 11. The locking member 2 has a substantially oblong cross-sectional profile matching that of the receiving chamber 111 of the support post 11 so that the locking member 2 is secured in the receiving chamber 111 of the support post 11 to prevent the locking member 2 from being rotated relative to the support post 11.

The locking member 2 is provided with a semi-circular locking hole 20 which has a planar locking side 25 which is provided with at least one engaging groove 21. The locking member 2 is further provided with a pin bore 22, and the armrest further comprises a positioning pin 24 extending through the pin holes 112 of the support post 11 and the pin bore 22 of the locking member 2 to fix the locking member 2 on the support post 11 of the armrest support 1. The locking member 2 has a side provided with a receiving recess 23, and the armrest further comprises a pressing pin 13 movably mounted in the passage 113 of the support post 11 and pressing an inner wall of the sleeve 4 to prevent the sleeve 4 from being vibrated or swayed when the sleeve 4 is movable relative to the support post 11 of the armrest support 1, and an elastic member 12 mounted in the receiving recess 23 of the locking member 2 and biased between the locking member 2 and the pressing pin 13 to push the pressing pin 13 toward the sleeve 4. The pressing pin 13 is partially received in the receiving recess 23 of the locking member 2.

The lifting device 3 includes a positioning member 33 located in an upper end of the sleeve 4 to move with the sleeve 4, a movable shaft 30 rotatably mounted on the positioning member 33 and detachably locked in the locking hole 20 of the locking member 2 by rotation of the movable shaft 30 relative to the locking member 2, a drive lever 31 pivotally mounted on the positioning member 33 and connected with the movable shaft 30 to drive the movable shaft 30 to rotate relative to the locking member 2 by pivot of the drive lever 31 relative to the positioning member 33, and a restoring member 32 biased between the positioning member 33 and the drive lever 31 and to push the drive lever 31 to pivot relative to the positioning member 33.

The armrest further comprises a mounting plate 5 secured on the upper end of the sleeve 4 to move with the sleeve 4, and the positioning member 33 of the lifting device 3 is secured on the mounting plate 5 to move with the mounting plate 5.

The movable shaft 30 of the lifting device 3 is an elongate rod and has a surface provided with a plurality of locking teeth 306 detachably engaged with the engaging groove 21 of the locking side 25 of the locking hole 20 of the locking member 2 and a planar side 307 located beside the locking teeth 306. The movable shaft 30 of the lifting device 3 has a periphery provided with a transverse drive rod 304.

Figure 6:
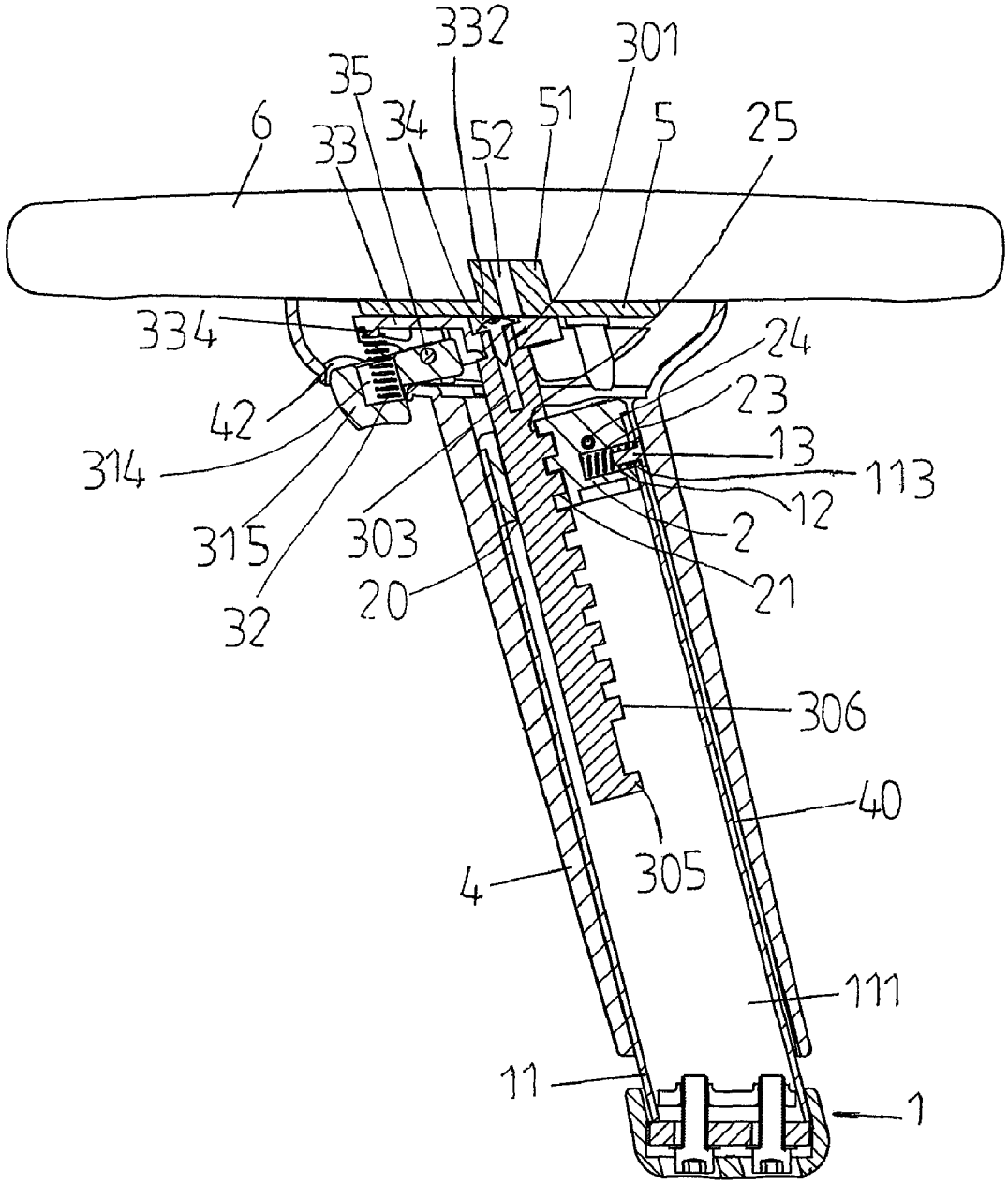
FIG. 6 is a front cross-sectional view of the armrest for a chair taken along line 6-6 as shown in FIG. 1.
Figure 8:
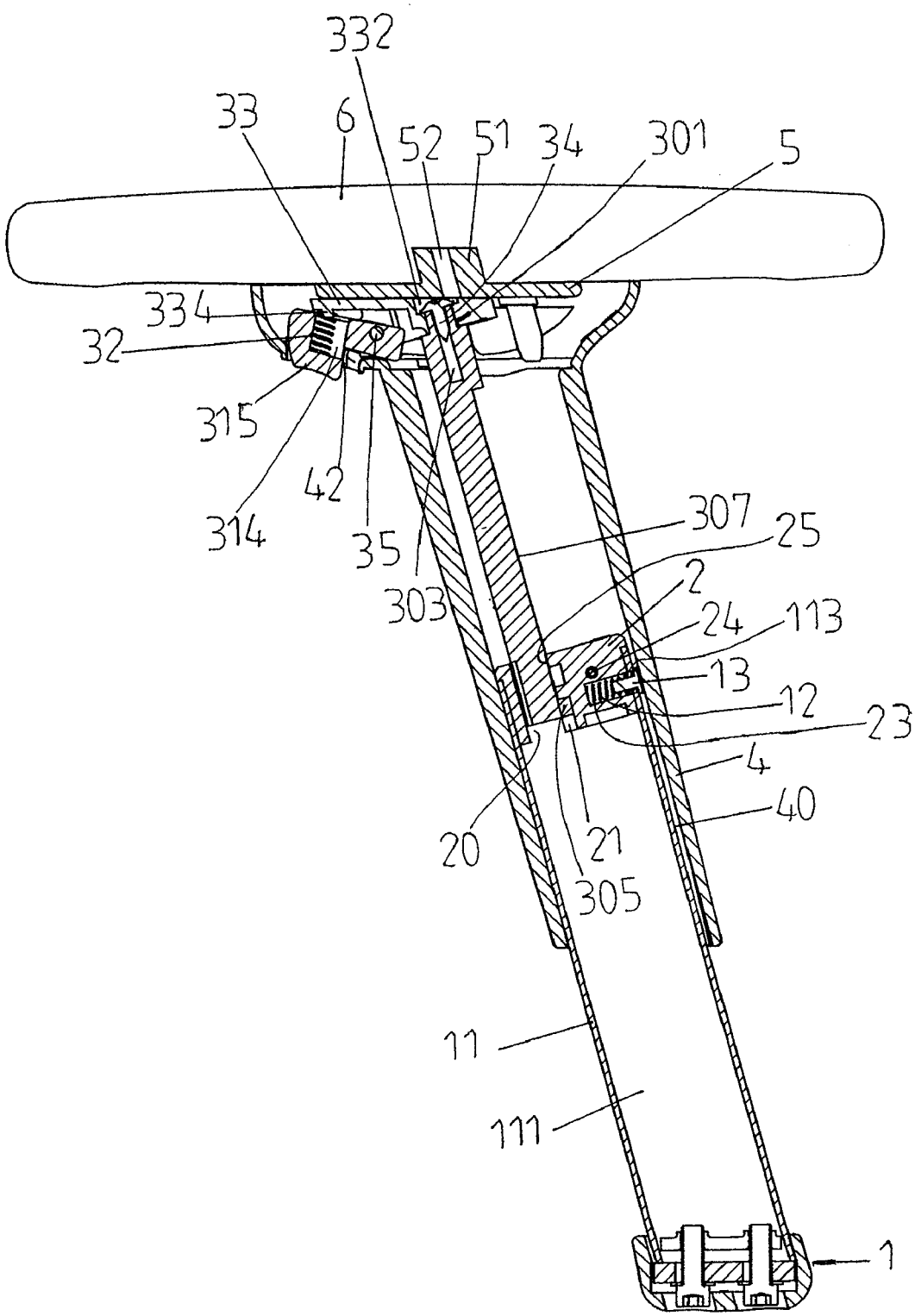
FIG. 8 is a schematic operational view of the armrest for a chair as shown in FIG. 6.

Thus, the movable shaft 30 of the lifting device 3 is rotatable relative to the locking member 2 between a first position as shown in FIG. 6 where the locking teeth 306 of the movable shaft 30 align with and are locked by the engaging groove 21 of the locking side 25 of the locking hole 20 of the locking member 2 to lock the movable shaft 30 onto the locking member 2 and a second position as shown in FIG. 8 where the planar side 307 of the movable shaft 30 aligns with and movably rests on the locking side 25 of the locking hole 20 of the locking member 2 to unlock the movable shaft 30 from the locking member 2 so that the movable shaft 30 is movable in the locking member 2 and the support post 11 of the armrest support 1 freely, and the sleeve 4 is movable on the support post 11 of the armrest support 1 freely.

The drive lever 31 of the lifting device 3 has a first end provided with a protruding push portion 311 which is movable relative to the movable shaft 30 to move the drive rod 304 of the movable shaft 30 and to drive and rotate the movable shaft 30 relative to the locking member 2, a second end provided with a protruding drive knob 315 to drive and pivot the drive lever 31 relative to the positioning member 33, and a mediate portion located between the push portion 311 and the drive knob 315 and pivotally mounted on the positioning member 33. The push portion 311 of the drive lever 31 is movable by pivot of the drive lever 31 relative to the positioning member 33 and is provided with an elongated guide slot 312 slidably mounted on the drive rod 304 of the movable shaft 30 to guide movement of the drive rod 304 of the movable shaft 30 relative to the drive lever 31. The guide slot 312 of the push portion 311 is inclined relative to the drive lever 31 of the lifting device 3. The mediate portion of the drive lever 31 is provided with a pivot hole 313. The second end of the drive lever 31 has a top provided with a receiving chamber 314 to receive the restoring member 32.

The positioning member 33 of the lifting device 3 has an inside provided with a through hole 332. The positioning member 33 of the lifting device 3 has a periphery provided with two opposite protruding ears 330 each provided with a screw hole 331. The positioning member 33 of the lifting device 3 has a bottom provided with a receiving space 333 to receive the restoring member 32. The receiving space 333 of the positioning member 33 has a wall provided with a protruding positioning post 334 inserted into the restoring member 32 to position the restoring member 32. The positioning member 33 of the lifting device 3 has two opposite sidewalls each provided with a fixing hole 335, and the armrest further comprises a pivot pin 35 extending through the fixing holes 335 of the positioning member 33 and the pivot hole 313 of the drive lever 31 so that the mediate portion of the drive lever 31 is pivotally mounted in the positioning member 33.

The movable shaft 30 of the lifting device 3 is movable in the locking hole 20 of the locking member 2 and the receiving chamber 111 of the support post 11. The movable shaft 30 of the lifting device 3 has an upper end provided with a reduced rotation rod 301 rotatably mounted in the through hole 332 of the positioning member 33. The rotation rod 301 of the movable shaft 30 is provided with a screw bore 303, and the armrest further comprises a fastening screw 34 extending through the through hole 332 of the positioning member 33 and screwed into the screw bore 303 of the rotation rod 301 to attach the movable shaft 30 to the positioning member 33. The drive rod 304 of the movable shaft 30 is located on the upper end of the movable shaft 30 and is movable to abut a top of the locking member 2 to stop movement of the movable shaft 30 relative to the locking member 2. The movable shaft 30 of the lifting device 3 has a lower end provided with an enlarged bottom edge 305 that is movable to abut a bottom of the locking member 2 to stop movement of the movable shaft 30 relative to the locking member 2 and to prevent the movable shaft 30 of the lifting device 3 from being detached from the locking member 2 and the support post 11 of the armrest support 1. The locking teeth 306 and the planar side 307 of the movable shaft 30 is located between the drive rod 304 and the bottom edge 305 of the movable shaft 30. The bottom edge 305 of the movable shaft 30 has a semi-circular shape.

The sleeve 4 is movably mounted on the support post 11 of the armrest support 1 and has an inside provided with a receiving hole 40 mounted on the support post 11 of the armrest support 1. The upper end of the sleeve 4 has a periphery provided with a plurality of screw bores 41. The upper end of the sleeve 4 has a surface provided with an exposing slot 42, and the drive knob 315 of the drive lever 31 protrudes outwardly from the exposing slot 42 of the sleeve 4.

The mounting plate 5 is provided with a plurality of through bores 53, and the armrest further comprises a plurality of fixing screws 54 each extending through a respective one of the through bores 53 of the mounting plate 5 and each screwed into a respective one of the screw bores 41 of the sleeve 4 to secure the mounting plate 5 to the sleeve 4. The mounting plate 5 is further provided with two through holes 50, and the armrest further comprises two locking screws 56 each extending through a respective one of the through holes 50 of the mounting plate 5 and each screwed into the screw hole 331 of a respective one of the protruding ears 330 of the positioning member 33 to secure the positioning member 33 to the mounting plate 5. The mounting plate has a top provided with a protruding mounting stud 51 which is provided with a screw bore 52 for fixing the support arm 6 to the mounting plate 5.

Figure 5:
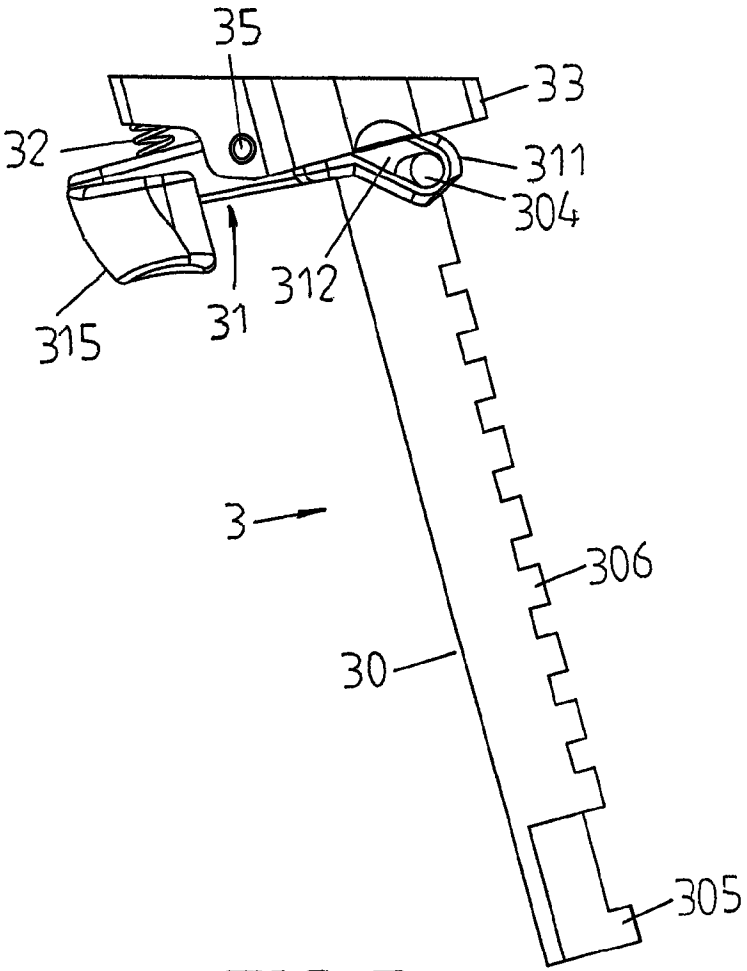
FIG. 5 is a front assembly view of the lifting device of the armrest for a chair as shown in FIG. 3.

In operation, referring to FIGS. 5-8 with reference to FIGS. 1-4, when the locking teeth 306 of the movable shaft 30 align with the locking side 25 of the locking hole 20 of the locking member 2, the locking teeth 306 of the movable shaft 30 are locked by the engaging groove 21 of the locking side 25 of the locking hole 20 of the locking member 2 as shown in FIG. 6 to lock the movable shaft 30 onto the locking member 2, so that the sleeve 4 is fixed on the support post 11 of the armrest support 1. At this time, the drive rod 304 of the movable shaft 30 is located at a lower end of the guide slot 312 of the drive lever 31 as shown in FIG. 5 when the locking teeth 306 of the movable shaft 30 align with the locking side 25 of the locking hole 20 of the locking member 2 as shown in FIG. 6.

Figure 7:
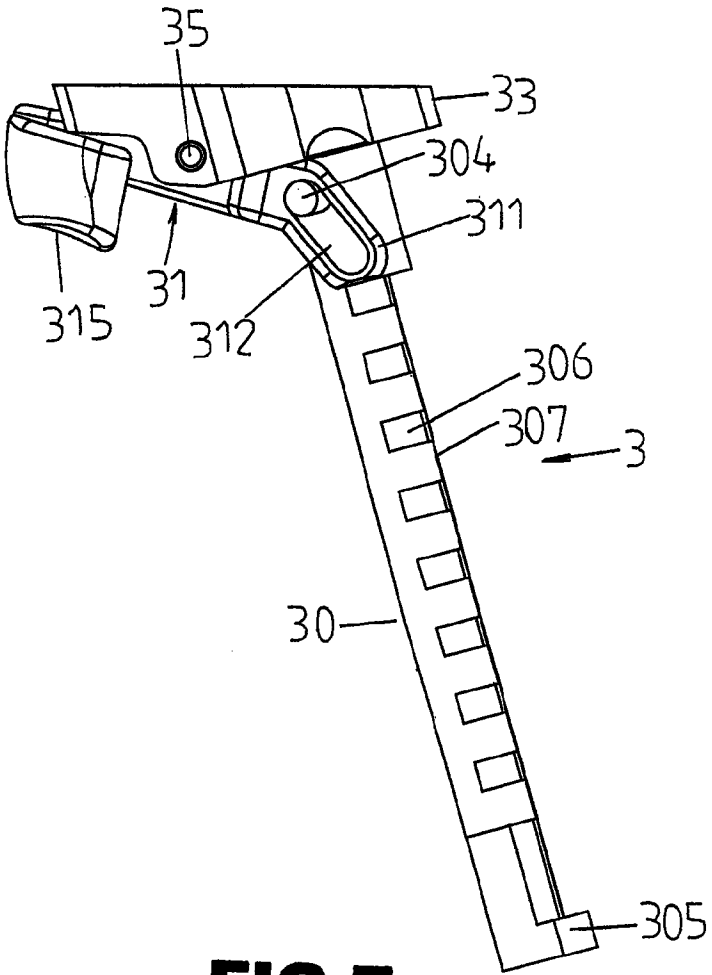
FIG. 7 is a schematic operational view of the armrest for a chair as shown in FIG. 5.

When the drive knob 315 of the drive lever 31 is pressed toward the positioning member 33 to compress the restoring member 32 and to drive and pivot the drive lever 31 relative to the positioning member 33 as shown in FIG. 7, the push portion 311 of the drive lever 31 is moved outwardly relative to the positioning member 33 to move the drive rod 304 of the movable shaft 30 and to drive and rotate the movable shaft 30 relative to the locking member 2, until the planar side 307 of the movable shaft 30 aligns with the locking side 25 of the locking hole 20 of the locking member 2 as shown in FIG. 8 so as to unlock the movable shaft 30 from the locking member 2, so that the movable shaft 30 is movable in the locking member 2 and the support post 11 of the armrest support 1 freely, and the sleeve 4 is movable on the support post 11 of the armrest support 1 freely. In such a manner, the sleeve 4 is movable relative to the support post 11 of the armrest support 1 to adjust the height of the support arm 6.

At this time, when the drive rod 304 of the movable shaft 30 is driven by the push portion 311 of the drive lever 31, the drive rod 304 of the movable shaft 30 is slidable in the guide slot 312 of the drive lever 31, so that the drive rod 304 of the movable shaft 30 is located at an upper end of the guide slot 312 of the drive lever 31 as shown in FIG. 7 when the planar side 307 of the movable shaft 30 aligns with the locking side 25 of the locking hole 20 of the locking member 2 as shown in FIG. 8.

After the force applied on the drive lever 31 disappears, the drive knob 315 of the drive lever 31 is pushed outwardly relative to the positioning member 33 by the restoring force of the restoring member 32 as shown in FIG. 5, to drive and pivot the drive lever 31 relative to the positioning member 33, and the push portion 311 of the drive lever 31 is moved toward the positioning member 33 to move the drive rod 304 of the movable shaft 30 and to drive and rotate the movable shaft 30 relative to the locking member 2, until the locking teeth 306 of the movable shaft 30 align with the locking side 25 of the locking hole 20 of the locking member 2, so that the locking teeth 306 of the movable shaft 30 are locked by the engaging groove 21 of the locking side 25 of the locking hole 20 of the locking member 2 as shown in FIG. 6 to lock the movable shaft 30 onto the locking member 2, and the sleeve 4 is fixed on the support post 11 of the armrest support 1 again.

Accordingly, when the drive knob 315 of the drive lever 31 is pressed upward, the movable shaft 30 is unlocked from the locking member 2 so that the movable shaft 30 is movable in the locking member 2 and the support post 11 of the armrest support 1 freely, and the sleeve 4 is movable relative to the support post 11 of the armrest support 1 to adjust the height of the support arm 6. In addition, a user only needs to press the drive knob 315 of the drive lever 31 so as to adjust the height of the support arm 6 so that the height of the support arm 6 is adjusted easily and quickly in an energy-saving manner, thereby facilitating the user adjusting the height of the support arm 6. Further, when the sleeve 4 is movable relative to the support post 11 of the armrest support 1, the pressing pin 13 is pushed by the elastic member 12 to press the inner wall of the sleeve 4 to prevent the sleeve 4 from being vibrated or swayed during movement of the sleeve 4 on the support post 11 of the armrest support 1. Further, the elastic member 12 provides a buffering effect to the sleeve 4 so that the sleeve 4 is movable on the support post 11 of the armrest support 1 smoothly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest for a chair, comprising:

an armrest support;

a sleeve movably and adjustably mounted on the armrest support;

a support arm mounted on the sleeve to move with the sleeve;

a locking member secured in the armrest support and located in the sleeve;

a lifting device mounted between the armrest support and the sleeve and operable between a first position where the lifting device is locked by the locking member to lock the sleeve onto the armrest support and a second position where the lifting device is unlocked from the locking member to unlock the sleeve from the armrest support so that the sleeve is movable relative to the armrest support freely; wherein the armrest support includes an upright support post having an inside provided with a receiving chamber to receive the lifting device;

the locking member is received in the receiving chamber of the support post and is provided with a semi-circular locking hole;

the lifting device includes:

a positioning member located in an upper end of the sleeve to move with the sleeve;

a movable shaft rotatably mounted on the positioning member and detachably locked in the locking hole of the locking member by rotation of the movable shaft relative to the locking member;

a drive lever pivotally mounted on the positioning member and connected with the movable shaft to drive the movable shaft to rotate relative to the locking member by pivot of the drive lever relative to the positioning member;

a restoring member biased between the positioning member and the drive lever and to push the drive lever to pivot relative to the positioning member;

the locking hole of the locking member has a planar locking side which is provided with at least one engaging groove;

the movable shaft of the lifting device has a surface provided with a plurality of locking teeth detachably engaged with the engaging groove of the locking side of the locking hole of the locking member and a planar side located beside the locking teeth;

the movable shaft of the lifting device is rotatable relative to the locking member between a first position where the locking teeth of the movable shaft align with and are locked by the engaging groove of the locking side of the locking hole of the locking member to lock the movable shaft onto the locking member and a second position where the planar side of the movable shaft aligns with and movably rests on the locking side of the locking hole of the locking member to unlock the movable shaft from the locking member so that the movable shaft is movable in the locking member and the support post of the armrest support, and the sleeve is movable on the support post of the armrest support:

the movable shaft of the lifting device has a periphery provided with a transverse drive rod;

the drive lever of the lifting device has a first end provided with a protruding push portion which is movable relative to the movable shaft to move the drive rod of the movable shaft and to drive and rotate the movable shaft relative to the locking member and a second end provided with a protruding drive knob to drive and pivot the drive lever relative to the positioning member;

the drive lever of the lifting device has a mediate portion located between the push portion and the drive knob and pivotally mounted on the positioning member;

the mediate portion of the drive lever is provided with a pivot hole;

the positioning member of the lifting device has two opposite sidewalls each provided with a fixing hole;

the armrest further comprises a pivot pin extending through the fixing holes of the positioning member and the pivot hole of the drive lever so that the mediate portion of the drive lever is pivotally mounted in the positioning member;

the push portion of the drive lever is movable when the mediate portion of the drive lever is pivotable about the pivot pin;

the push portion of the drive lever is provided with an elongated guide slot slidably mounted on the drive rod of the movable shaft to guide movement of the drive rod of the movable shaft relative to the drive lever;

the second end of the drive lever has a top provided with a receiving chamber to receive the restoring member;

the positioning member of the lifting device has a bottom provided with a receiving space to receive the restoring member.

2. The armrest for a chair of claim 1, wherein the receiving space of the positioning member has a wall provided with a protruding positioning post which extends downward and is inserted into an upper end of the restoring member to position the restoring member.

3. The armrest for a chair of claim 1, wherein the positioning member of the lifting device has an inside provided with a stepped through hole;

the movable shaft of the lifting device has an upper end provided with a reduced rotation rod inserted into and rotatably mounted in the through hole of the positioning member.

4. The armrest for a chair of claim 3, wherein the rotation rod of the movable shaft is provided with a screw bore which extends axially along the movable shaft;

the armrest further comprises a fastening screw extending through the through hole of the positioning member and screwed into the screw bore of the rotation rod to attach the movable shaft to the positioning member.

5. The armrest for a chair of claim 1, wherein the movable shaft of the lifting device is movable in the locking hole of the locking member and the receiving chamber of the support post;

the drive rod of the movable shaft is located on and extended transversely from the upper end of the movable shaft and is movable to abut a top of the locking member to stop downward movement of the movable shaft relative to the locking member;

the movable shaft of the lifting device has a lower end provided with an enlarged bottom edge that is movable to abut a bottom of the locking member to stop movement of the movable shaft relative to the locking member and to prevent the movable shaft of the lifting device from being detached from the locking member and the support post of the armrest support.

6. The armrest for a chair of claim 5, wherein the locking teeth and the planar side of the movable shaft are located between the drive rod and the bottom edge of the movable shaft.

7. The armrest for a chair of claim 1, further comprising:

a mounting plate secured on the upper end of the sleeve to move with the sleeve;

wherein the positioning member of the lifting device is secured on the mounting plate to move with the mounting plate.

8. The armrest for a chair of claim 7, wherein the positioning member of the lifting device has a periphery provided with two opposite protruding ears each provided with a screw hole;

the mounting plate is further provided with two through holes;

the armrest further comprises two locking screws each extending through a respective one of the through holes of the mounting plate and each screwed into the screw hole of a respective one of the protruding ears of the positioning member to secure the positioning member to the mounting plate.

9. The armrest for a chair of claim 7, wherein the upper end of the sleeve has a periphery provided with a plurality of screw bores;

the mounting plate is provided with a plurality of through bores;

the armrest further comprises a plurality of fixing screws each extending through a respective one of the through bores of the mounting plate and each screwed into a respective one of the screw bores of the sleeve to secure the mounting plate to the sleeve.

10. The armrest for a chair of claim 1, wherein the sleeve is movably mounted on the support post of the armrest support and has an inside provided with a receiving hole mounted on the support post of the armrest support;

the upper end of the sleeve has a bottom surface provided with an exposing slot;

the drive knob of the drive lever protrudes outwardly from the exposing slot of the sleeve.

11. The armrest for a chair of claim 1, wherein the locking member is mounted on an upper end of the support post;

the upper end of the support post is provided with two opposite pin holes each extending transversely;

the locking member is provided with a pin bore extending transversely;

the armrest further comprises a transversely extended positioning pin extending through the pin holes of the support post and the pin bore of the locking member to fix the locking member on the support post of the armrest support.

12. The armrest for a chair of claim 1, wherein the sleeve is movably mounted on the support post of the armrest support and has an inside provided with a receiving hole mounted on the support post of the armrest support;

the locking member is mounted on an upper end of the support post;

the upper end of the support post is provided with a passage extending transversely;

the locking member has a side provided with a receiving recess extending transversely;

the armrest further comprises:

a transversely extended pressing pin movably mounted in the passage of the support post and pressing an inner wall of the sleeve;

an elastic member mounted in the receiving recess of the locking member and biased between the locking member and the pressing pin to push the pressing pin toward the sleeve.

13. The armrest for a chair of claim 12, wherein the pressing pin is partially received in the receiving recess of the locking member and partially received in the receiving hole of sleeve.

14. The armrest for a chair of claim 1, wherein the guide slot of the push portion is inclined relative to the drive lever of the lifting device and is inclined relative to the drive rod of the movable shaft.

* * * * *